United States Patent [19]

Pralle

[11] 3,963,289

[45] June 15, 1976

[54] GREETING CARD DISPLAY

[76] Inventor: Lois A. Pralle, 14687 Kazan, Irvine, Calif. 92714

[22] Filed: Sept. 23, 1974

[21] Appl. No.: 508,187

[52] U.S. Cl. ..... 312/245; 312/114; 312/214; 40/10 D

[51] Int. Cl.[2] ..... A47F 3/00

[58] Field of Search ..... 312/245, 214, 114, 234.1, 312/118, 50, 207; 40/16 R, 10 D; 206/45.34

[56] References Cited

UNITED STATES PATENTS

| | | | |
|---|---|---|---|
| 1,126,258 | 1/1915 | Myers | 312/114 |
| 1,186,642 | 6/1916 | Alamy | 312/114 |
| 1,848,262 | 3/1932 | Meyer | 40/16 |
| 1,986,077 | 1/1935 | Spang | 312/114 |
| 2,176,698 | 10/1939 | Albrecht | 40/10 D |
| 2,403,469 | 7/1946 | Tucker | 312/214 |
| 2,548,706 | 4/1951 | Corning | 206/45.34 |
| 2,886,917 | 5/1959 | Yates | 312/245 |

*Primary Examiner*—Paul R. Gilliam
*Assistant Examiner*—Victor N. Sakran
*Attorney, Agent, or Firm*—Harvey C. Nienow

[57] ABSTRACT

A greeting card display comprising an enclosure formed of transparent front and side walls and wherein partition means is provided forming a pair of spaced receptacles.

A greeting card having a front cover and a back cover is cut in half, and each of such covers is placed in a separate one of such receptacles. The front cover can be viewed through the transparent front wall of the enclosure and the rear cover can be viewed through the transparent side walls. Means for hanging the enclosure on a wall is also included.

1 Claim, 3 Drawing Figures

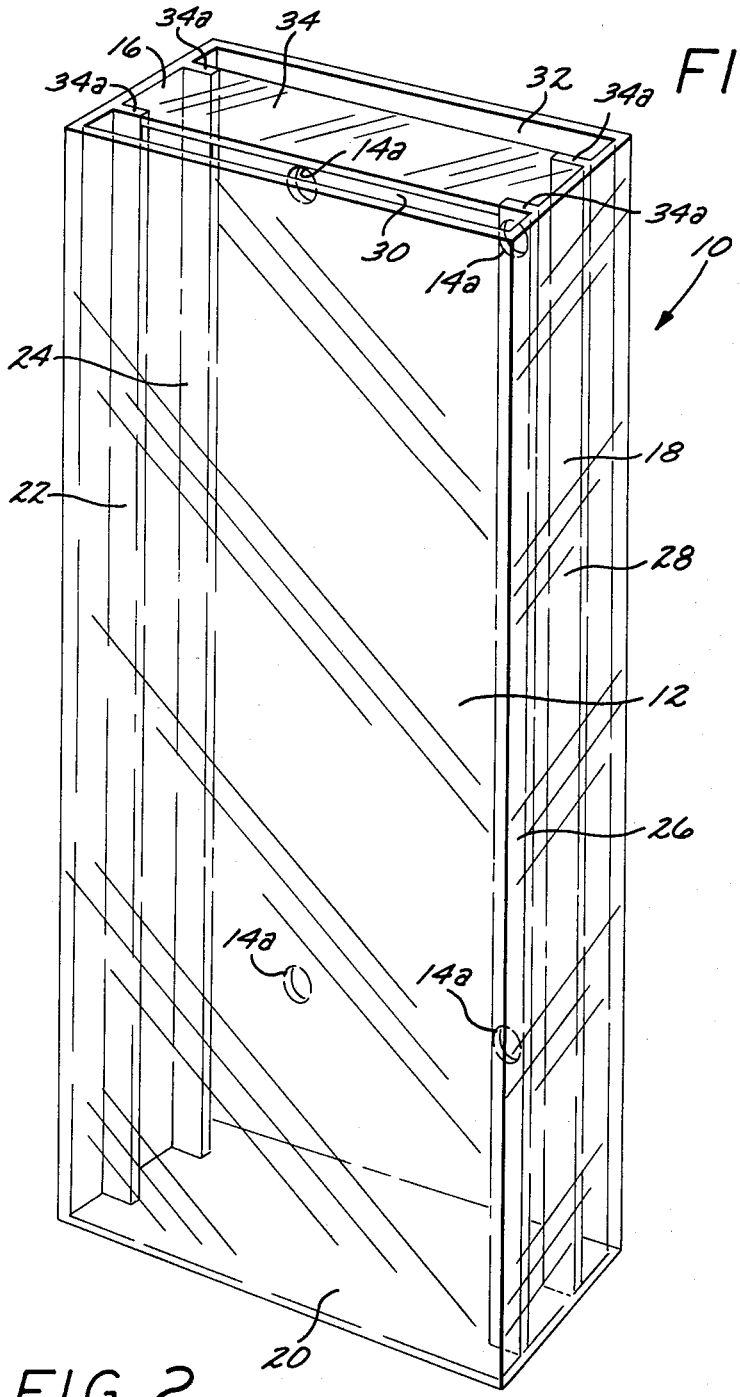
FIG. 1
FIG. 3
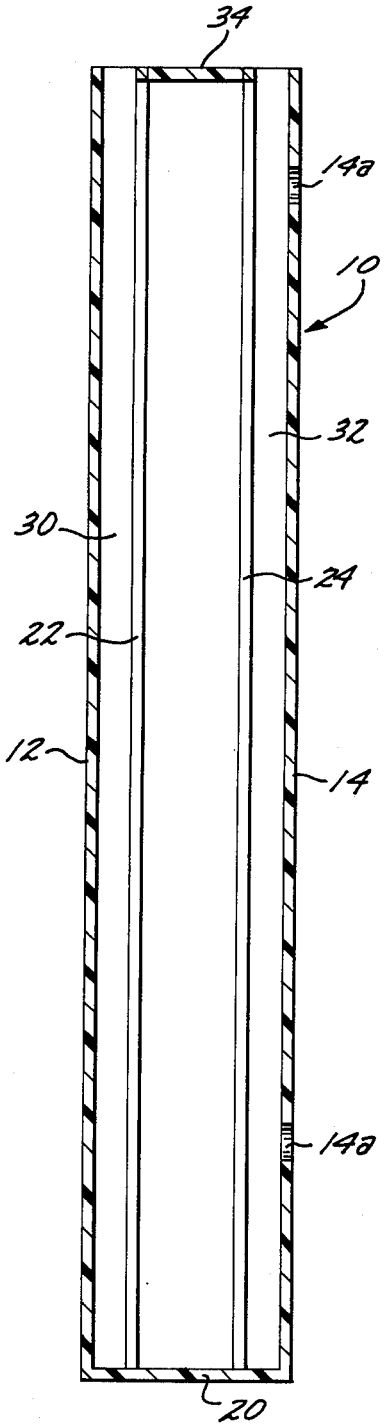
FIG. 2
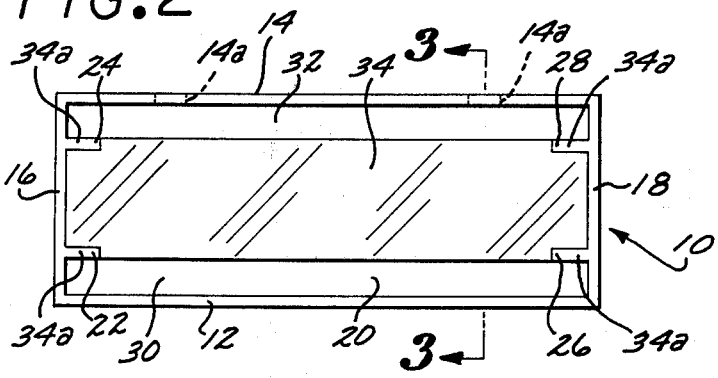

GREETING CARD DISPLAY

The present invention relates generally to greeting card displays, and more particularly to displays for showing both the front and rear covers of a greeting card.

Not infrequently, a person will receive an extremely interesting, thoughtful and decorative greeting card, and in the matter of a few seconds it is discarded or put aside, never to be used again. That is, most, if not all, greeting cards are viewed and read for several seconds, but are never again used for any purpose whatever. This is so, in spite of the fact that many greeting cards, particularly today, are extremely decorative, and contain versus or thoughts which are worth reading again and again. These are certainly worth sharing with other people.

Due to the fact that most greeting cards are folded in two so as to have a front cover and a rear cover, it is difficult to properly display or share the same. Thus, it has been deemed desirable for some period of time, to provide a greeting card display which is capable of displaying both the front cover and the rear cover in a manner simulating the actual relationship thereof in the card.

It is an object of the present invention to provide a greeting card display which will allow the card to be fully viewed, both the forward and rearward covers thereof.

Another object of the present invention is to provide a greeting card display as characterized above which is operable to protect the card from being handled by viewers.

A still further object of the present invention is to provide a greeting card display as characterized above which can be placed on a table or other stand or which can be hung on a wall.

Another further object of the present invention is to provide a greeting card display as characterized above which is formed of transparent plastic material.

A still further object of the present invention is to provide a greeting card display as characterized above which is simple and inexpensive to manufacture and which is rugged and dependable in operation.

The novel features which I consider characteristic of my invention are set forth with particularity in the appended claims. The invention itself, however, both as to its organization and mode of operation, together with additional objects and advantages thereof, will best be understood from the following description of specific embodiments when read in connection with the accompanying drawings, in which:

FIG. 1 is a perspective view of a greeting card display according to the present invention;

FIG. 2 is a top plan view of the greeting card display of FIG. 1; and

FIG. 3 is a longitudinal sectional view taken substantially along line 3—3 of FIG. 2 of the drawings.

Like reference characters indicate corresponding parts throughout the several views of the drawings.

Referring to FIG. 1 of the drawings, there is shown therein an enclosure 10 having a front wall 12, a rear wall 14 and a pair of side walls 16 and 18. Each such wall is formed of plastic sheet material which is transparent, although, according to the present invention, rear wall 14 is not required to be transparent. In fact, rear wall 14 may be formed of translucent material, if desired.

Enclosure 10 further includes a bottom wall 20 formed of transparent plastic material. The various side walls and bottom wall are firmly fastened together with suitable bonding material to provide the enclosure 10 shown in FIG. 1 of the drawings. In the alternative, the various front, rear and side walls could be extruded as a single unitary structure, and the bottom wall 20 thereafter attached to provide the enclosure 10, if this is desired. As will hereinafter become more apparent, it is desirable to have the bonding material between the various walls be transparent so that a person's view will not be disrupted.

The rear wall 14 is formed with suitable mounting holes **14*a* whereby the enclosure 10** can be hung from any suitable vertical surface as for instance the wall of a room or the like.

Positioned within enclosure 10 and extending the length thereof are four partition members 22, 24, 26, and 28. Each such partition member is firmly secured to the respective side wall, the members 22 and 24 being secured to side wall 16 and the members 26 and 28 being secured to side wall 18.

The partition members 22 and 26 constitute a pair and are individually spaced from the front wall 12 to form a forward receptacle 30. The rearward partition members 24 and 28 are individually spaced from the rear wall 14 to form a rearward receptacle 32. Such receptacles extend the entire length and width of the forward and rearward walls for reasons which will hereinafter become more apparent.

Attached to the upper end of the side walls 16 and 18 (as shown in FIG. 1) and between the partition members 22 and 24 on one side and between the partition members 26 and 28 on the other side, is a transparent end member 34 having four corner cutouts 34a as shown. Such end member 34 assists the partition members in providing the aforementioned receptacles 30 and 32.

The greeting card display 10 is utilized to display both the front cover of a greeting card as well as the printed verse or handwritten comments and signature on the rear cover thereof. The card is separated, and the front cover is inserted into receptacle 30 such that the decorative front surface of the cover is viewable through the transparent wall 12. In like fashion, the rear cover is inserted into the receptacle 32 with the verse and handwritten comments exposed forwardly, toward the front cover.

Whereas the front cover is viewable through the transparent front wall 12, the verse and comments on the rear cover are viewable through the side walls 16 and 18, or through the bottom wall 20 and end wall 34. That is, the subject enclosure 10 can be positioned vertically or horizontally depending upon the size and shape of the greeting card such that viewing can take place through either the side walls 16 and 18 or the bottom wall 20 and end wall 34.

The fact that the partition member provide the receptacles 30 and 32 in spaced relation, enables the rear cover to be viewable around the front cover. This maintains the front and rear covers in their logical relationship, namely, in the relationship in which they were received as a complete greeting card.

It is thus seen that the present invention provides a greeting card display which conveniently and effectively shows all of the artistic and sentimental portions of a greeting card.

I claim:

1. A greeting card display comprising in combination:

a. a generally rectangular inclosure comprising a transparent imperforate front wall, a pair of transparent imperforate side walls, a transparent top wall, an imperforate bottom wall, and a rear wall;

b. said front and rear walls being substantially wider than said side walls;

c. four substantially similar partitions positioned inside said inclosure and extending substantially from said top wall to said bottom wall with two of said partitions situated on each of said side walls;

d. said partitions being parallel to one another and arranged on said side walls as a forward pair and a rearward pair with one partition from each pair situated on one side wall in alignment with the other partition of that pair on the other side wall;

e. said partitions extending from said side walls substantially the same distance and substantially parallel to said front and rear walls;

f. said forward pair of partitions forming within said inclosure a forward receptacle adjacent said front wall and said rearward pair of partitions forming a rearward receptacle adjacent said rear wall, said receptacles individually receiving separate portions of a greeting card and said receptacles being spaced from each other;

g. said forward pair of partitions being closer to said forward wall and said rearward pair of partitions being closer to said rearward wall than either pair of partitions is to each other and providing a substantial space between said forward and rearward receptacles to permit viewing a first portion of a greeting card through said front wall and a second portion of the greeting card through that portion of said side walls between said forward and rearward receptacles; and, h. said top wall covering the substantial space between said forward and rearward receptacles leaving only said forward and rearward receptacles open at the top for insertion of the greeting card portions.

* * * * *